US006261384B1

(12) United States Patent
Kolberg et al.

(10) Patent No.: US 6,261,384 B1
(45) **Date of Patent: *Jul. 17, 2001**

(54) PROCESS AND AQUEOUS SOLUTION FOR PHOSPHATIZING METALLIC SURFACES

(75) Inventors: Thomas Kolberg, Heppenheim; Peter Schubach, Nidderau, both of (DE)

(73) Assignee: Metallgesellschaft Aktiengesellschaft, Frankfurt am Main (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/254,166

(22) PCT Filed: Aug. 11, 1997

(86) PCT No.: PCT/EP97/04360

§ 371 Date: Mar. 10, 1999

§ 102(e) Date: Mar. 10, 1999

(87) PCT Pub. No.: WO98/08999

PCT Pub. Date: Mar. 5, 1998

(30) Foreign Application Priority Data

Aug. 28, 1996 (DE) ..... 196 34 685

(51) Int. Cl.[7] ..... C23C 22/07
(52) U.S. Cl. ..... 148/260; 148/262; 148/279
(58) Field of Search ..... 148/254, 260, 148/262, 279

(56) References Cited

U.S. PATENT DOCUMENTS 3,855,147 * 12/1974 Granquist ..... 252/317
5,268,041 * 12/1993 Gehmecker et al. ..... 148/260

OTHER PUBLICATIONS

"ASM Handbook, Formerly Ninth Edition, Metals Handbook, vol. 13, Corrosion", 1987, pp. 383–388.*

* cited by examiner

*Primary Examiner*—John Sheehan
*Assistant Examiner*—Andrew L. Oltmans
(74) *Attorney, Agent, or Firm*—Herbert Dubno; Jonathan Myers

(57) ABSTRACT

A process is disclosed for preparing an aqueous zinc phosphatizing solution for producing phosphate coatings on metallic surfaces of iron, steel, zinc, zinc alloys, aluminum or aluminum alloys, which comprises:

(1) 0.3 to 5 g $Zn^{2+}$/1;

(2) 0.1 to 3 g nitroguanidine/1 as an accelerator;

(3) phosphate where the acid value is 0.03 to 0.3 indicating the ratio of free acid, calculated as free $P_2O_5$ to the total $P_2O_5$, and the weight ratio of Zn to $P_2O_5$ is 1:5 to 1:30; and (4) balance water, where the solution produces finely crystallite phosphate coatings in which the crystallites have a maximum edge length <15 $\mu$m, which comprises the steps of:

(a) preparing a concentrate comprising the $Zn^{2+}$ and the phosphate in water;

(b) supplying additional water to the concentrate so that the $Zn^{2+}$ concentration in the phosphatizing solution is 0.3 to 5 g/1;

(c) preparing a stabilized suspension consisting essentially of 100 to 300 g of nitroguanidine/1, 10 to 30 g of sheet silicate/1 as stabilizer and the balance water by suspending the sheet silicate in deionized water and stirring the nitroguanidine into the suspension; and (d) introducing the stabilized suspension into the phosphatizing solution so that the nitroguanidine concentration in the phosphatizing solution is 0.1 to 3 g nitroguanidine/liter.

17 Claims, No Drawings

PROCESS AND AQUEOUS SOLUTION FOR PHOSPHATIZING METALLIC SURFACES

FIELD OF THE INVENTION

This invention relates to an aqueous, phosphate-containing solution for producing phosphate coatings on metallic surfaces of iron, steel, zinc, zinc alloys, aluminum or aluminum alloys. This invention furthermore relates to a process for phosphatizing by using an aqueous phosphatizing solution.

BACKGROUND OF THE INVENTION

From the DE-PS 750 957 there is known a process for improving the corrosion resistance of metals, in particular of iron and steel, by treating them in a solution forming phosphate coatings, where the solution contains an accelerator, and where nitromethane, nitrobenzene, picric acid, a nitroaniline, a nitrophenol, a nitrobenzoic acid, a nitroresorcinol, nitrourea, a nitrourethane or nitroguanidine is used as accelerator. The optimum concentration for the individual accelerators is different, but in the phosphatizing solutions it is generally in the range between 0.01 and 0.4 wt-%. For the accelerator nitroguanidine the optimum concentration is said to be 0.2 wt-%. From the DE-OS 38 00 835 there is known a process of phosphatizing metal surfaces, in particular surfaces of iron, steel, zinc and the alloys thereof as well as aluminum, as a pretreatment for the cold working, where without activation at a temperature in the range from 30 to 70° C. the surface is brought in contact with an aqueous solution containing 10 to 40 g $Ca^{2+}$/l, 20 to 40 g $Zn^{2+}$/l, 10 to 100 g $PO_4^{3-}$/l and as accelerator 10 to 100 g $NO_3^-$/l and/or 0.1 to 2.0 g organic nitro compounds per liter, where the solution has a pH value in the range from 2.0 to 3.8 and a ratio of free acid to total acid of 1:4 to 1:100. As accelerator, an m-nitrobenzene-sulfonate and/or nitroguanidine may be used. The phosphate coatings produced in accordance with the known process have coating weights of 3 to 9 g/m$^2$.

Although it is known per se that nitroguanidine can be used as accelerator when phosphatizing metallic surfaces, the practical use of this accelerator meets with some difficulties, as the phosphatizing results achieved are very frequently unsatisfactory. This is quite obviously due to the fact that the effect of the accelerator nitroguanidine very much depends on the inorganic components of the phosphatizing solution and the concentration of the inorganic components of the phosphatizing solution, so that the phosphate coatings produced by using nitroguanidine only have good functional properties when one succeeds in providing a phosphatizing solution in which the individual components are adjusted to each other such that when using nitroguanidine as accelerator, phosphate coatings of good, constant quality can be produced also in a continuous operation. Moreover, the interaction between the nitroguanidine and the remaining components of the phosphatizing solution cannot be predicted or determined by theoretical considerations or simple experiments, but must be determined by extensive experiments on different phosphatizing systems. The frequently unsatisfactory results are also due to the poor water solubility and the uneven distribution of the nitroguanidine.

OBJECT OF THE INVENTION

It is therefore the object underlying the invention to create an aqueous solution for phosphatizing metallic surfaces, which contains nitroguanidine as accelerator, and whose remaining components are adjusted to each other such that the phosphate coatings formed during phosphatizing are finely crystalline, have a low coating weight, provide for a good lacquer adhesion and ensure a good protection against corrosion. It is furthermore the object underlying the invention to create a process of phosphatizing which uses the phosphatizing solution in accordance with the invention, where the process should operate at temperatures as low as possible, may be used for phosphatizing different metallic surfaces, and should operate by using simple technical means as well as to be safe in operation.

SUMMARY OF THE INVENTION

The object underlying the invention is obtained by preparing an aqueous, phosphate-containing solution for producing phosphate coatings on metallic surfaces of iron, steel, zinc, zinc alloys, aluminum or aluminum alloys, which contains 0.3 to 5 g $Zn^{2+}$/l, and 0.1 to 3 g nitroguanidine/l, where the acid value is 0.03 to 0.3 and the weight ratio of $Zn:P_2O_5$=1:5 to 1:30, and which produces finely crystalline phosphate coatings, in which the crystallites have a maximum edge length <15 $\mu$m. It has surprisingly turned out that by means of the phosphatizing solution in accordance with the invention very finely crystalline phosphate coatings can be produced, which effect a good lacquer adhesion and a good protection against corrosion. The crystallites have a laminated, cuboid or cubic shape and always have a maximum-edge length <15 $\mu$m, which in general is even <10 $\mu$m. Furthermore, the phosphatizing solution in accordance with the invention is very well suited for phosphatizing cavities. The phosphate coatings deposited on the metallic articles from the inventive phosphatizing solution have a coating weight of 1.5 to 4.5 g/m$^2$, preferably of 1.5 to 3 g/m$^2$, so that the lacquer adhesion is favorably influenced. With a zinc content >5 g/l the anticorrosive properties and the lacquer adhesion deteriorate significantly.

The ratio of $Zn:P_2O_5$ is based on the total $P_2O_5$. The determination of the total $P_2O_5$ is based on the titration of the phosphoric acid and/or the primary phosphates from the equivalence point of the primary phosphate to the equivalence point of the secondary phosphate. The acid value indicates the ratio of free acid, calculated as free $P_2O_5$, to the total $P_2O_5$. The definitions and determination methods for the total $P_2O_5$ and the free $P_2O_5$ are explained in detail in the publication by W. Rausch "Die Phosphatierung von Metallen", 1988, pages 299 to 304.

In accordance with the invention it is particularly advantageous when the aqueous, phosphate-containing solution contains 0.3 to 3 g $Zn^{2+}$/l and 0.1 to 3 g nitroguanidine/l, where the acid value is 0.03 to 0.3 and the weight ratio of $Zn:P_2O_5$=1:5 to 1:30. With this inventive solution, which due to its zinc content of 0.3 to 3 g/l is suited for performing the low-zinc phosphatizing, particularly good results were achieved on the whole.

In accordance with the invention the aqueous solution should contain 0.5 to 20 g $NO_3^-$/l. The inventive nitrate content favorably influences the maintenance of the optimum coating weight of 1.5 to 4.5 g/m. The nitrate is added to the phosphatizing solution in the form of alkali nitrates and/or by means of the cations present in the system, e.g. as zinc nitrate, and/or as $HNO_3$. Since the nitrate-free aqueous solution also provides good phosphatizing results, the known accelerating effect of the nitrate is in all probability of minor importance in the present case.

In accordance with the invention it is furthermore provided that the phosphatizing solution contains 0.01 to 3 g $Mn^{2+}$/l and/or 0.01 to 3 g $Ni^{2+}$/l and/or 1 to 100 mg $Cu^{2+}$/l and/or 10 to 300 mg $Co^{2+}$/l. These metal ions are incorporated in the phosphate coating and improve lacquer adhesion and protection against corrosion.

In accordance with a further aspect of the invention it is provided that the aqueous phosphatizing solution contains 0.01 to 3 g $F^-$/l and/or 0.05 to 3.5 g/l complex fluorides, preferably ($SiF_6$) or ($BF_4$). The fluoride is added to the phosphatizing solution when metallic surfaces consisting of aluminum or aluminum alloys should be phosphatized. The complex fluorides are added to the phosphatizing solution in particular for stabilization, so that a longer dwell time of the phosphatizing baths is achieved.

The object underlying the invention is furthermore obtained by employing a process of phosphatizing, where the metallic surfaces are cleaned, are subsequently treated with the aqueous, phosphate-containing phosphatizing solution for a period of 5 seconds to 10 minutes at a temperature of 15 to 70° C., and are finally rinsed with water. This process can be performed with simple technical means and is extremely safe in operation. The phosphate coatings produced by means of this process have a constantly good quality, which does not even decrease with an extended operating time of the phosphatizing bath. The minimum phosphatizing time is shorter in the process in accordance with the invention than in known low-zinc processes employing the usual accelerators. Minimum phosphatizing time is considered to be the time in which the surface is covered with a phosphate coating for 100%.

In accordance with the invention it is provided that the treatment of the metallic surfaces with the phosphatizing solution is effected by spraying, dipping, spray dipping or roller application. These working techniques open a very wide and different range of applications to the process in accordance with the invention. In accordance with the invention it turned out to be particularly advantageous when the phosphatizing solution used for spraying has a weight ratio of $Zn:P_2O_5$=1:10 to 1:30, and when the phosphatizing solution used for dipping has a weight ratio of $Zn:P_2O_5$=1:5 to 1:18.

In accordance with the invention it is often advantageous when after cleaning the metallic surfaces are treated with an activator that contains a titanium-containing phosphate. This a supports the formation of a closed, finely crystalline zinc phosphate coating.

Finally, it is provided in accordance with the invention that after the rinsing operation following the phosphatizing, the metallic surfaces are aftertreated with a passivating agent. The passivating agents used may both contain Cr and be free from Cr.

In the cleaning of the metallic surfaces provided in accordance with the inventive process both mechanical impurities and adhering fats are removed from the surface to be phosphatized. The cleaning of the metallic surfaces belongs to the known prior art and can advantageously be performed with an aqueous-alkaline cleaner. Expediently, the metallic surfaces are rinsed with water after cleaning. Rinsing the cleaned or phosphatized metallic surfaces is effected either with tap water or with deionized water.

The phosphatizing solution in accordance with the invention is produced in that about 30 to 90 g of a concentrate containing the inorganic components of the phosphatizing solution as well as water are filled up with water to 1 l. Subsequently, the provided amount of nitroguanidine is introduced into the phosphatizing solution in the form of a suspension or as powder. The solution is then ready for use, and the substances consumed during phosphatizing can continuously be completed by adding the concentrate and the nitroguanidine.

To avoid the difficult dosage of the nitroguanidine as powder, it is provided in accordance with the invention that the nitroguanidine is introduced into the aqueous solution in the form of a stabilized suspension. In accordance with the invention, the suspension is stabilized with a sheet silicate. This suspension contains 100 to 300 g nitroguanidine/l, 10 to 30 g sheet silicate/l and the rest water. It can easily be delivered by means of pumps and is stable over 12 months, i.e. the nitroguanidine does not precipitate even after an extended period. The suspension is prepared in that the sheet silicate is suspended in 1 l fully deionized water, and then the nitroguanidine is stirred into the same. At the pH value of 2 to 3 existing in the phosphatizing solution, the suspension is destroyed, and the nitroguanidine is released in a fine distribution. In accordance with the invention, the sheet silicates $[Mg_6(Si_{7.4}Al_{0.6})O_{20}(OH)_4]Na_{0.6}.xH_2O$ and $[(Mg_{5.4}Li_{0.6})Si_8O_{20}(OH_3F)_4]Na_{0.6}.xH_2O$ turned out to be particularly useful. These are synthesized smectite-type three-layer silicates. The sheet silicates have no disadvantageous effect on the formation of the phosphate coatings. Apart from their actual advantageous effect they also improve the sedimentation of the phosphate sludge and increase its solids content.

The subject-matter of the invention will subsequently be explained in detail with reference to embodiments.

The embodiments 1 and 2 were performed by means of the following process steps:

a) The surfaces of metallic articles consisting of steel sheet were cleaned for 5 minutes at 60° C. with a weakly alkaline cleaner (2% aqueous solution) and degreased in particular.

b) Then, rinsing with tap water was effected for 0.5 minutes at room temperature.

c) Subsequently, an activation was effected with an activator (3 g/l $H_2O$) containing a titanium phosphate for a period of 0.5 minutes at room temperature.

d) Then, phosphatizing was performed by dipping at about 550° C. for 3 minutes.

e) Finally, rinsing was performed with tap water for 0.5 minutes at room temperature.

f) The phosphatized surfaces were dried with compressed air.

The composition of the aqueous solutions used for phosphatizing and the properties of the phosphate coatings are indicated in Table 1.

In accordance with the embodiments 1 and 2, comparative tests were made with phosphatizing solutions known per se, which contained, however, a different accelerator (Comparative Tests A and B). In addition, a comparative test was made with a phosphatizing solution which was non-inventive as regards the ratio $ZN:P_2O_5$, and which contained nitroguanidine as accelerator (Comparative Test C). In the Comparative Tests A, B. C the process steps a) to f) were performed. The composition of the phosphatizing solutions used for the comparative tests and the properties of the phosphate coatings are indicated in Table 2.

The comparison of the embodiments 1 and 2 with the Comparative Tests A, B and C reveals that with the phosphatizing solution in accordance with the invention as against the known and well-tried phosphatizing solutions good results are achieved, but where the nitroguanidine has much better functional properties than the accelerator $NO_2^-$ The Comparative Test C reveals that only by using the inventive parameters good and practical phosphatizing results are achieved.

The embodiments 3 and 4 were performed by using the following process conditions, where it should in particular be checked whether the invention was suited for phosphatizing cavities: Steel sheets were treated in a box simulating a cavity in accordance with process steps a) to e), which were also employed in the embodiments 1 and 2. Drying the phosphatized steel sheets was effected in the cavity (box) at room temperature without compressed air. The composition of the aqueous solutions used for phosphatizing a cavity and the properties of the phosphate coatings are indicated in Table 3.

As regards the coating weight, crystallite edge length and minimum phosphatizing time, the phosphate coatings of the embodiments 3 and 4 approximately had the same properties as the phosphate coatings of the embodiments 1 and 2.

In accordance with the embodiments 3 and 4 the Comparative Tests D and E were made, where the individual process steps were identical. The phosphatizing solutions used in the Comparative Tests D and E are known per se and contain hydroxylamine as accelerator. The composition of the solutions used for performing the Comparative Tests D and E and the properties of the phosphate coatings are indicated in Table 4.

A comparison of the embodiments 3 and 4 with the Comparative Tests D and E reveals that with the invention a very good phosphatizing of cavities can be achieved, as in accordance with the invention complete, closed phosphate coatings are produced, and there is no formation of flash rust. The term "formation of flash rust" includes that on the metallic surface which does not have a complete, closed phosphate coating a rust layer is formed upon drying, which is very disadvantageous. In some cases, there is no formation of flash rust, although there is no complete, closed phosphate coating, which should be due to a passivation of the metallic surface by the phosphatizing solution.

For checking the corrosion properties of and the lacquer adhesion on various metallic substrates phosphatized in accordance with the invention lacquer adhesion values were determined.

In Table 5, the lacquer adhesion and corrosion protection values are indicated, which were determined for different sheets (substrates), where the individual substrates in accordance with Examples 5, 6 and 7 were phosphatized by dipping with inventive solutions, and the substrates in accordance with Comparative Tests F and G were phosphatized by dipping with known solutions. Dipping the individual substrates was effected in accordance with the aforementioned process steps a) to f). The composition of the phosphatizing solutions used for Examples 5, 6 and 7 is indicated in Table 7. There are also indicated the compositions of the known phosphatizing solutions used for performing the Comparative Tests F and G. After phosphatizing the substrates by dipping, an electrodeposition paint, a filler and a finishing paint were applied. Subsequently, an outdoor weathering test was made, evaluated after 6 months, a salt-spray test and a test by flying stones after an alternate climatic test over 12 rounds. In Table 5 the subsurface corrosion of the lacquer coating, measured in mm, is indicated, which was determined in the individual tests, where for the flying-stones test the exfoliation of lacquer is indicated in percent.

In Table 6, the lacquer adhesion and corrosion protection values are indicated for various substrates, which were phosphatized by spraying. Spray phosphatizing the substrates was performed in accordance with the invention by using the following process steps:

g) The surfaces of the substrates were cleaned with a weakly alkaline cleaner (2% aqueous solution) for 5 minutes at 60° C. and degreased in particular.

h) Subsequently, rinsing with tap water was effected for 0.5 minutes at room temperature.

i) Then, spray phosphatizing was performed for 2 minutes at 55° C.

k) Subsequently, rinsing was performed with a chromium-free rinsing agent, which contained $(ZrF_6)^{2-}$, at room temperature for 1 minute, so as to passivate the phosphatized substrates.

l) Finally, rinsing was performed with fully deionized water for 1 minute at room temperature.

m) The phosphatized substrates were dried in the oven for 10 minutes at 80° C.

The compositions of the inventive aqueous phosphatizing solutions, which were used for performing Examples 8, 9 and 10, are indicated in Table 8. The composition of the known phosphatizing solution, which was used for carrying out Comparative Test H, is likewise indicated in Table 8. On the substrates phosphatized by spraying, an electrodeposition paint, a filler and a finishing paint were then applied. The phosphatized and painted substrates were then subjected to an outdoor weathering test for 6 months, a salt-spray test, a cross-cut test and an alternate climatic test over 12 rounds and subsequently to flying stones. In Table 6 the values determined for the individual substrates are indicated, where for the cross-cut test a rating is indicated, and for the outdoor weathering test, the salt-spray test and the alternate climatic test the subsurface corrosion of the lacquer coating is indicated, measured in mm. For the flying stones, the exfoliation of lacquer is indicated in percent.

The protection against corrosion, which is achieved by the inventive phosphatizing process, can be compared with the corrosion protection achieved by using well-tried, known phosphatizing processes, which employ nitrite as accelerator. In the inventive phosphatizing process, however, the use of the accelerator nitrite is avoided, the use of which increasingly meets with disapproval, as during phosphatizing reaction products are formed from nitrite, which are harmful to the environment and are in part toxic for man. The lacquer adhesion and anticorrosive effect achieved by means of the inventive phosphatizing process must be evaluated as very good to good.

TABLE 1

| | Example 1 | Example 2 |
|---|---|---|
| $Zn^{2+}$ | 1.4 g/l | 1.4 g/l |
| $Mn^{2+}$ | 1.0 g/l | 1.0 g/l |
| $Ni^{2+}$ | 1.0 g/l | — |
| $Cu^{2+}$ | — | 8 mg/l |
| $NO_3^-$ | 3.0 g/l | 3.0 g/l |
| $PO_4^{3-}$ (total) | 18.0 g/l | 18.0 g/l |
| $=P_2O_5$ (total) | 13.5 g/l | 13.5 g/l |
| Nitroguanidine | 0.5 g/l | 0.5 g/l |
| $Na^+$ | the amount required for the adjustment of titration data | |
| Acid value | 0.09 | 0.09 |
| Coating weight | 2.4 g/m2 | 2.6 g/m2 |
| Crystallite edge length | 2–8 μm | 2–8 μm |
| Minimum phosphatizing time | <60 sec | <60 sec |

TABLE 2

| | Comparative Test A | Comparative Test B | Comparative Test C |
|---|---|---|---|
| $Zn^{2+}$ | 1.4 g/l | 1.4 g/l | 3.5 g/l |
| $Ni^{2+}$ | 1.0 g/l | 1.0 g/l | — |
| $Mn^{2+}$ | 1.0 g/l | 1.0 g/l | — |
| $P_2O_5$ (total) | 12.0 g/l | 12.0 g/l | 5.5 g/l |
| Acid value | 0.07 | 0.09 | 0.35 |
| $NO_3^-$ | 3.0 g/l | 3.0 g/l | 3.0 g/l |
| $H_2O_2$ | 30 mg/l | — | — |
| $NO_2^-$ | — | 170 mg/l | — |
| Nitroguanidine | — | 2.0 g/l | — |
| $Na^+$ | the amount required for the adjustment of titration data | | |
| Coating weight | 1.3 g/m$^2$ | 2.2 g/m$^2$ | 4.9 g/m$^2$ |
| Crystallite edge length | 40 $\mu$m | 10 $\mu$m | 20 to 25 $\mu$m |
| Minimum phosphatizing time | 120 sec | 60 sec | 60 sec |

TABLE 3

| | Example 3 | Example 4 |
|---|---|---|
| $Zn^{2+}$ | 1.4 g/l | 1.9 g/l |
| $Ni^{2+}$ | 1.0 g/l | 1.0 g/l |
| $Mn^{2+}$ | 1.0 g/l | 1.0 g/l |
| $P_2O_5$ (total) | 12.0 g/l | 12.0 g/l |
| Acid value | 0.09 | 0.09 |
| $NO_3^-$ | 3.0 g/l | 3.0 g/l |
| Nitroguanidine | 0.5 g/l | 0.9 g/l |
| $Na^+$ | the amount required for the adjustment of titration data | |
| Complete, closed phosphate coating | yes | yes |
| Formation of flash rust | no | no |

TABLE 4

| | Comparative Test D | Comparative Test E |
|---|---|---|
| $Zn^{2+}$ | 1.4 g/l | 1.9 g/l |
| $Ni^{2+}$ | 1.0 g/l | 1.0 g/l |
| $Mn^{2+}$ | 1.0 g/l | 1.0 g/l |
| $P_2O_5$ (total) | 12.0 g/l | 12.0 g/l |
| Acid value | 0.09 | 0.09 |
| $NO_3^-$ | 3.0 g/l | 3.0 g/l |
| Hydroxylamine | 1.0 g/l | 1.0 g/l |
| $Na^+$ | the amount reguired for the adjustment of titration data | |
| Complete, closed phosphate coating | no | no |
| Formation of flash rust | yes | yes |

TABLE 5

Lacquer adhesion values, dip application

| | Examples | | | Comparative Tests | |
|---|---|---|---|---|---|
| Substrate | 5 | 6 | 7 | F | G |
| Outdoor weathering for 6 months, mm subsurface corrosion, measured unilaterally from the scratch. | | | | | |
| Steel | <1 | <1 | 1.5 | <1 | 2.5 |
| Zinc-plated steel | 1 | 1 | 1 | 1.5 | 2.5 |
| Galvanized steel | 0 | <1 | 1 | 0 | <1 |
| Steel with Fe-Zn coating | <1 | <1 | <1 | <1 | <1 |
| AlMgSi, unpolished | 3 | 0 | 0 | <1 to 3 | — |

TABLE 5-continued

Lacquer adhesion values, dip application

| | Examples | | | Comparative Tests | |
|---|---|---|---|---|---|
| Substrate | 5 | 6 | 7 | F | G |
| AlMgSi, polished | 5 | <1 | 0 | 4 | — |
| Salt-spray test, 1008 h, according to DIN 50021 SS, mm subsurface corrosion | | | | | |
| Steel | <1 | <1 | 1.5 | <1 | 1 |
| Alternate climatic test over 12 rounds according to VDA 621-415, subsurface corrosion in mm, measured unilaterally from the scratch, and subsequently flying stones according to specification of VW AG, % exfoliation of lacquer, indicated in () | | | | | |
| Steel | <1(0.5) | <1(0.5) | 1.5(0.5) | <1(1) | 2(2) |
| Zinc-plated steel | 6.5(1.5) | 7(8.5) | 7(5) | 5.5(2) | 8(40) |
| Galvanized steel | 1.5(0.5) | 2(7) | 2(2) | 1(0.5) | 2.5(15) |
| Steel with Fe-Zn coating | 1(0.5) | 1(0.5) | 1(0.5) | 1(0.5) | 1(0.5) |

TABLE 6

Lacquer adhesion values, spray application

| | Examples | | | Comparative Test |
|---|---|---|---|---|
| Substrate | 8 | 9 | 10 | H |
| Outdoor weathering for 6 months, mm subsurface corrosion, measured unilaterally from the scratch. | | | | |
| Steel | <1 | 1 | <1 | <1 |
| Zinc-plated steel | <1 | 1.5 | 1.5 | 1.5 |
| Galvanized steel | 0 | 0 | 0 | 0 |
| Steel with Fe-Zn coating | 0 | <1 | <1 | <1 |
| AlMgSi, unpolished | 0 | 0 | 0 | 2 |
| AlMgSi, polished | 0 | 0 | 2.5 | 5 |
| Salt-spray test, 1008 h, according to DiN 50021 SS, mm subsurface corrosion | | | | |
| Steel | <1 | <1 | <1 | <1 |
| Cross-cut test after 240 h, according to DIN 50017 KK and DIN/ISO 2409, rating | | | | |
| Steel | 1 | 2 | 1 | 1 |
| Zinc-plated steel | 1 | 1 | 1–2 | 1 |
| Galvanized steel | 1 | 1 | 2 | 1 |
| Steel with Fe-Zn layer | 1 | 1 | 1 | 1 |

TABLE 6-continued

| Lacquer adhesion values, spray application | | | | |
|---|---|---|---|---|
| | Examples | | | Comparative Test |
| Substrate | 8 | 9 | 10 | H |
| AlMgSi, unpolished | 1 | 0 | 3 | 1 |
| AlMgSi, polished | 1 | 0–1 | 3 | 1 |
| Alternate climatic test over 12 rounds according to VDA 621-415, subsurface corrosion in mm, measured unilaterally from the scratch, and subsequently flying stones according to the specification of VW AG, % exfoliation of lacquer, indicated in () | | | | |
| Steel | <1 (2) | 1 (5) | <1 (2) | <1 (2) |
| Zinc-plated steel | 5 (5.5) | 5.5 (9) | 6 (14) | 5.5 (4) |
| Galvanized steel | 1.5 (1) | 2.5 (2) | 2.5 (1.5) | 1.5 (1) |
| Steel with Fe-Zn coating | 1 (1) | 1 (2) | 1 (1) | 1 (1) |

TABLE 7

| Substance/ | Examples | | | Comparative Tests | |
|---|---|---|---|---|---|
| Value | 5 | 6 | 7 | F | G |
| $Zn^{2+}$ | 1.4 g/l | 1.4 g/l | 1.4 g/l | 1.4 g/l | 3.5 g/l |
| $Mn^{2+}$ | 1.0 g/l | 1.0 g/l | 1.0 g/l | 1.0 g/l | — |
| $Ni^{2+}$ | 1.0 g/l | — | — | 1.0 g/l | — |
| $Cu^{2+}$ | — | 8 mg/l | — | — | — |
| $NO_3^-$ | 3.0 g/l | 3.0 g/l | 3.0 g/l | 3.0 g/l | 3.0 g/l |
| $P_2O_5$ (total) | 13.5 g/l | 13.5 g/l | 13.5 g/l | 12.0 g/l | 5.5 g/l |
| Nitroguanidine | 0.5 g/l | 0.5 g/l | 0.5 g/l | — | 2 g/l |
| $NO_2^-$ | — | — | — | 170 mg/l | — |
| Acid value | 0.09 | 0.09 | 0.09 | 0.09 | 0.35 |

TABLE 8

| Substance/ | Examples | | | Comparative Test |
|---|---|---|---|---|
| Value | 8 | 9 | 10 | H |
| $Zn^{2+}$ | 0.9 g/l | 0.9 g/l | 0.9 g/l | 0.9 g/l |
| $Mn^{2+}$ | 1.0 g/l | 1.0 g/l | 1.0 g/l | 1.0 g/l |
| $Ni^{2+}$ | 1.0 g/l | — | — | 1.0 g/l |
| $Cu^{2+}$ | — | 5 mg/l | — | — |
| $NO_3^-$ | 3.0 g/l | 30 g/l | 30 g/l | 3.0 g/l |
| $P_2O_5$ (total) | 11 g/l | 11 g/l | 11 g/l | 11 g/l |
| Nitroguanidine | 0.5 g/l | 0.5 g/l | 0.5 g/l | — |
| $NO_2^-$ | — | — | — | 150 mg/l |
| Acid value | 0.07 | 0.07 | 0.07 | 0.07 |

What is claimed is:

1. A process for preparing an aqueous zinc phosphatizing solution for producing phosphate coatings on metallic surfaces of iron, steel, zinc, zinc alloys, aluminum, or aluminum alloys wherein the zinc phosphatizing solution comprises:

(1) 0.3 to 5 g $Zn^{2+}$/l;

(2) 0.1 to 3 g nitroguanidine/l as an accelerator;

(3) stabilizer;

(4) phosphate where the acid value is 0.03 to 0.3 indicating the ratio of free acid, calculated as free $P_2O_5$ to the total $P_2O_5$, and the weight ratio of Zn to $P_2O_5$, is 1:5 to 1:30; and (5) balance water, where the solution produces finely crystallite phosphate coatings in which the crystallites have a maximum edge length <15 $\mu$m, wherein said process comprises the steps of:

(a) preparing a concentrate comprising the $Zn^{2+}$ and the phosphate in water;

(b) supplying additional water to the concentrate to form a diluted concentrate so that the $Zn^{2+}$ concentration in the zinc phosphatizing solution will be 0.3 to 5 g/l;

(c) preparing a stabilized suspension containing 100 to 300 g of nitroguanidine/l, a stabilizer for the suspension and the balance water by suspending the stabilizer for the suspension in deionized water and stirring the nitroguanidine into the suspension; and (d) introducing the stabilized suspension into the dilute concentrate so that the nitroguanidine concentration in the zinc phosphatizing solution is 0.1 to 3 g nitroguanidine/liter.

2. The process for preparing an aqueous zinc phosphatizing solution defined in claim 1 wherein according to step (c) the stabilizer is $[Mg_6(Si_{7.4}Al_{0.6})O_{20}(OH)_4]Na_{0.6}.xH_2O$ or $[(Mg_{5.4}Li_{0.6})Si_8O_{20}(OH_3F)_4]Na_{0.6}.xH_2O$.

3. The aqueous zinc phosphatizing solution prepared by the process defined in claim 1.

4. The aqueous zinc phosphatizing solution defined in claim 3 which further comprises 0.5 to 20 g $NO_3^-$/l.

5. The aqueous zinc phosphatizing solution defined in claim 3 which further comprises 0.01 to 3 g $Mn^{2+}$/l and/or 0.01 to 3 g $Ni^{2+}$/l and/or 1 to 100 mg $Cu^{2+}$/l and/or 10 to 300 mg $Co^{2+}$/l.

6. The aqueous zinc phosphatizing solution defined in claim 3 which further comprises 0.01 to 3 g $F^-$/l and/or 0.05 to 3.5 g/l of at least one complex fluoride.

7. The aqueous zinc phosphatizing solution defined in claim 6 which further comprises $(SiF_6)^{2-}$ or $(BF_4)^-$ as complex fluoride.

8. The aqueous zinc phosphatizing solution defined in claim 3 wherein the stabilizer is $[Mg_6(Si_{7.4}Al_{0.6})O_{20}(OH)_4]Na_{0.6}.xH_2O$ or $[(Mg_{5.4}Li_{0.6})Si_8O_{20}(OH_3F)_4]Na_{0.6}.xH_2O$.

9. A process for phosphatizing a metallic surface of iron, steel, zinc, zinc alloys, aluminum, or aluminum alloys which comprises the steps of:

(1) cleaning the metallic surface;

(2) following step (1), treating the cleaned metallic surface with an aqueous zinc phosphatizing solution prepared by the process defined in claim 1; and (3) finally rinsing the treated metallic surface with water.

10. The process for phosphatizing a metallic surface defined in claim 9 wherein according to step (2) the treatment of the metallic surface with the phosphatizing solution is effected by spraying, dipping, spray dipping, or roller application.

11. The process for phosphatizing a metallic surface defined in claim 10 wherein the phosphatizing solution is sprayed and has a weight ratio of Zn to $P_2O_5$ of 1:10 to 1:30.

12. The process for phosphatizing a metallic surface defined in claim 10 wherein the phosphatizing solution is dipped and has a weight ratio of Zn to $P_2O_5$ of 1:5 to 1:18.

13. The process for phosphatizing a metallic surface defined in claim 10 wherein following step (1) the cleaned metallic surface is treated with an activator which contains a titanium-containing phosphate.

14. The,process for phosphatizing a metallic surface defined in claim 10 wherein following step (3) the rinsed metallic surface is treated with a passivating agent.

15. The process for phosphatizing a metallic surface defined in claim 9 wherein the stabilizer is $[Mg_6(Si_{7.4}Al_{0.6})$ $O_{20}(OH)_4]Na_{0.6}.xH_2O$ or $[(Mg_{5.4}Li_{0.6})Si_8O_{20}(OH_3F)_4]Na_{0.6}.xH_2O$.

16. The process for phosphatizing a metallic surface defined in claim 9 wherein the phosphatizing of the metallic surface takes place prior to painting.

17. The process for phosphatizing a metallic surface defined in claim 16 wherein the painting is carried out by electro-dipcoating.

* * * * *